US007641514B2

(12) United States Patent
Chen et al.

(10) Patent No.: US 7,641,514 B2
(45) Date of Patent: Jan. 5, 2010

(54) ELECTRICAL CONNECTOR ASSEMBLY

(75) Inventors: Yong-Jun Chen, ShenZhen (CN); Xian-Kui Shi, ShenZhen (CN); Yi Zhou, ShenZhen (CN); Chung-Yen Yang, Tu-cheng (TW)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 12/387,105

(22) Filed: Apr. 28, 2009

(65) Prior Publication Data

US 2009/0269977 A1 Oct. 29, 2009

(30) Foreign Application Priority Data

Apr. 28, 2008 (CN) ..... 2008 2 0300641 U

(51) Int. Cl.
*H01R 13/648* (2006.01)

(52) U.S. Cl. ..... 439/540.1; 439/95; 439/607.25; 439/607.27

(58) Field of Classification Search ..... 439/540.1, 439/607.25, 607.27, 607.23
See application file for complete search history.

(56) References Cited

U.S. PATENT DOCUMENTS 6,456,503 B1 * 9/2002 Murasawa et al. ..... 361/799
7,044,790 B2 * 5/2006 Zhu et al. ..... 439/607.27
7,118,414 B2 10/2006 Spears et al.
2007/0032129 A1 * 2/2007 Kim et al. ..... 439/540.1
2008/0214045 A1 * 9/2008 Tu et al. ..... 439/540.1

* cited by examiner

*Primary Examiner*—Gary F. Paumen
(74) *Attorney, Agent, or Firm*—Wei Te Chung; Andrew C. Cheng; Ming Chieh Chang

(57) ABSTRACT

An electrical connector assembly (100) includes a connector holder (2) defining a plurality of positioning cavities (2101) therein, and at least a slot (2103) located in a front portion of each of the positioning cavities; a plurality of grounding members (5) respectively mounted to the positioning cavities, each of the grounding members (5) having a body portion (50), a first contacting portion (51) connected to a front edge of the body portion, a second contacting portion (52) connected to a back edge of the body portion and at least an arm (53) connected to a lateral edge of the body portion, said at least an arm received in the at least a slot, and the first contacting portion disposed out of the connector holder; a plurality of connectors respectively mounted to the positioning cavities, each of the connectors having a metallic shell contacting the second contacting portion; and a metallic cage (4) enclosing the connector holder and the connectors, with the first contacting portion contacting inner surface of the metallic cage.

15 Claims, 8 Drawing Sheets

ELECTRICAL CONNECTOR ASSEMBLY

BACKGROUND OF THE INVENTION

1. Field of the Invention

The present invention generally relates to an electrical connector assembly, and more particularly to an electrical connector assembly with multi-ports.

2. Description of Related Art

Computers have become an essential part of modern business. Through advances in chip design and manufacture, the cost of personal computers has dropped dramatically in recent years to the point where such personal computers are affordable by most consumers. As part of an effort to lower manufacturing costs, manufacturers have been looking for ways to more easily, reliably and flexibly assemble their computers.

While much attention has been paid to advances in chip design and manufacture, comparatively little effort has been put into optimizing the input and output connections to a personal computer. The input connections for a personal computer often involve input ports for a keyboard, mouse, joystick, microphone, and more recently, multi-use universal serial bus ("USB") connectors. The output connections for a personal computer often involve output ports for a printer, video monitor, modem and audio loudspeakers.

Thus far, a patch work of approaches has been used for installing input/output connector ports onto a computer. Historically, connector ports have been located at the rear of the computer housing where they are difficult for the user to access. In the case of audio and visual connector ports, they have often been built as part an electrical circuit-board which must then be screwed onto the computer housing. Other connectors, such as USB and high speed communications connectors, have been wrapped in a plastic plug which again must be screwed onto the computer housing. All of this screwing of connector ports onto a computer housing is labor intensive and, therefore, expensive. Moreover, present techniques for installing connector ports onto a computer housing allow little flexibility to change the type of connector ports being used if the manufacturer wants to use the same connector assembly for both high end computers with many connector ports and low end computers with fewer connector ports.

U.S. Pat. No. 7,118,414 B2 discloses a kind of computer input/output connector assembly which uses connector port holders that can easily be snapped into a metallic retaining bracket. In one preferred embodiment, the bracket of the present invention is mounted on the front of a personal computer tower. Connected to the bracket is a first connector port holder with two USB connector ports, a second connector port holder with an IEEE 1394 high speed communication port, a third connector port holder with three audio ports (e.g., audio in, audio out and microphone) and a fourth connector port holder with two video ports (e.g., RCA composite video and S-video). However, the aforementioned connector port holders are combined together via ultrasonic welding technique, and once one of the port involved in the connector port holder is broken, it may cause the whole connector port holder to be replaced, for it difficult to repair such integral connector port holder.

Furthermore, with increasing of the transmitting speed, Electro-Magnetic Interference (EMI) becomes more severe, which may influence signals transmitting.

Hence, an improved electrical connector assembly is highly desired to overcome the disadvantages of the related art.

SUMMARY OF THE INVENTION

Accordingly, an object of the present invention is to provide an easily manufactured electrical connector assembly with a grounding device.

In order to achieve the object set forth, an electrical connector assembly comprising a a connector holder defining a plurality of positioning cavities therein, and at least a slot located in a front portion of each of the positioning cavities; a plurality of grounding members respectively mounted to the positioning cavities, each of the grounding members having a body portion, a first contacting portion connected to a front edge of the body portion, a second contacting portion connected to a back edge of the body portion and at least an arm connected to a lateral edge of the body portion, said at least an arm received in the at least a slot, and the first contacting portion disposed out of the connector holder; a plurality of connectors respectively mounted to the positioning cavities, each of the connectors having a metallic shell contacting the second contacting portion; and a metallic cage enclosing the connector holder and the connectors, with the first contacting portion contacting inner surface of the metallic cage.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
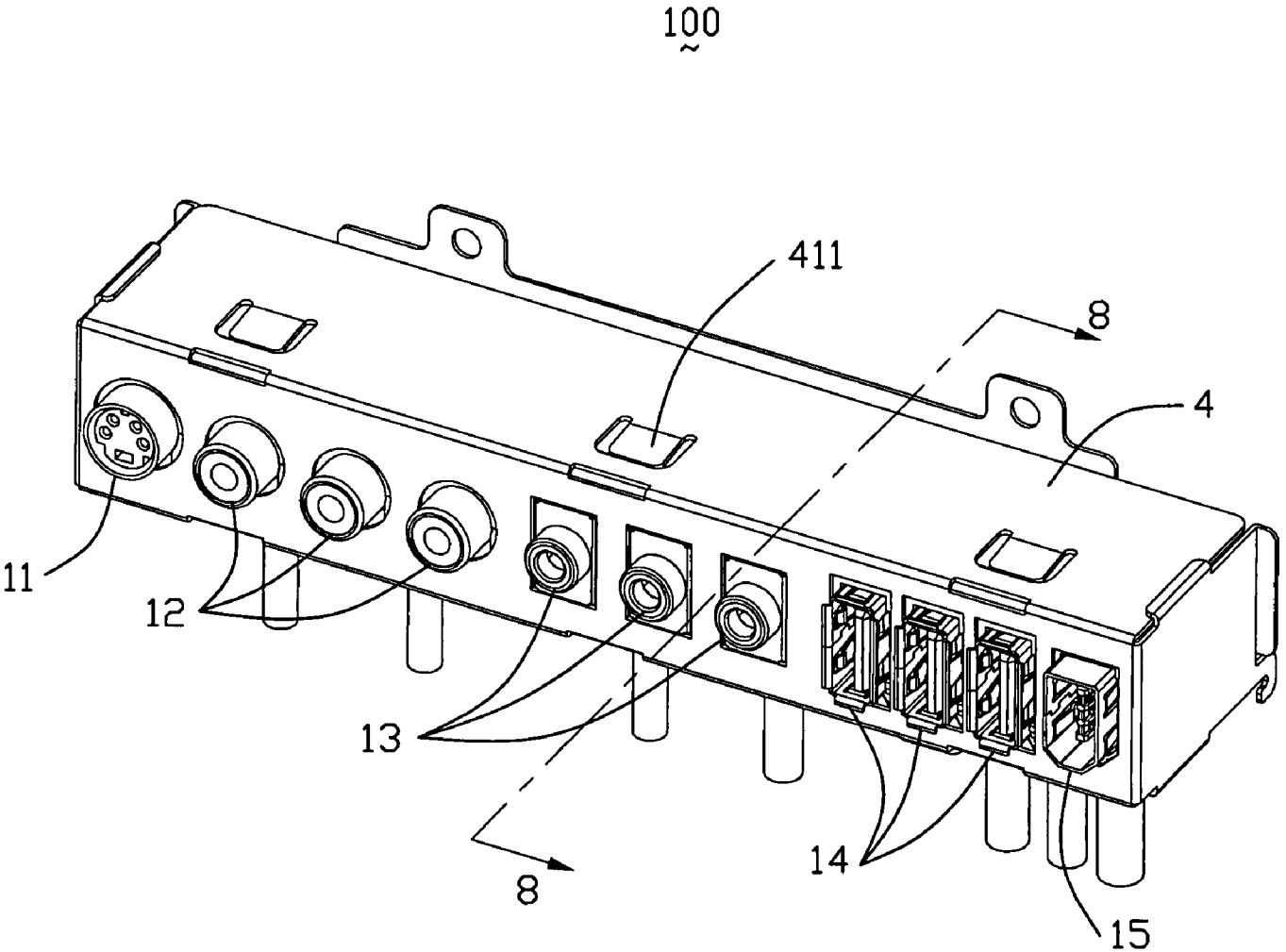
FIG. 1 is an assembled, perspective view of an electrical connector assembly in accordance with the present invention.
Figure 2:
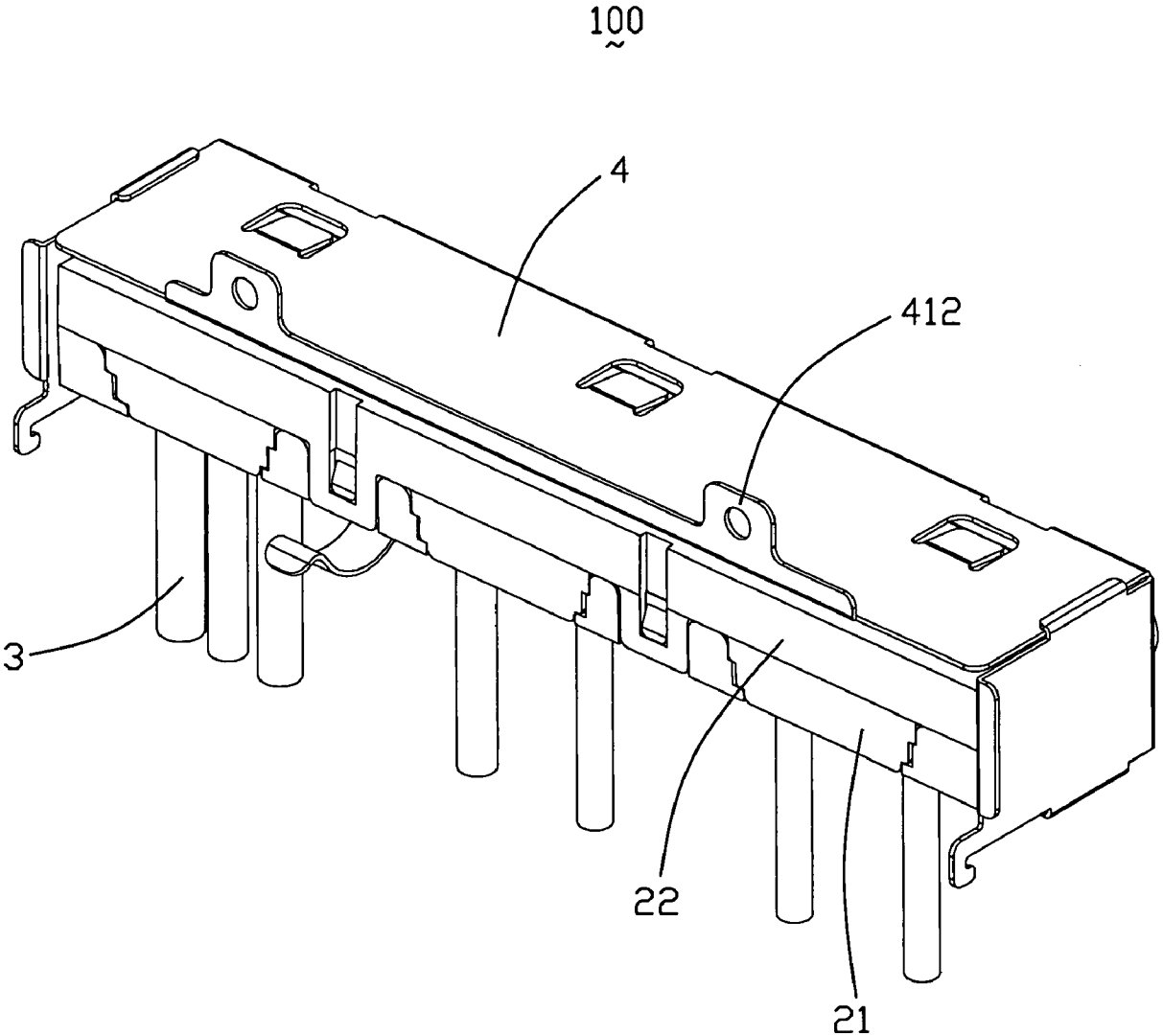
FIG. 2 is a view similar to FIG. 1, but viewed from another aspect.
Figure 3:
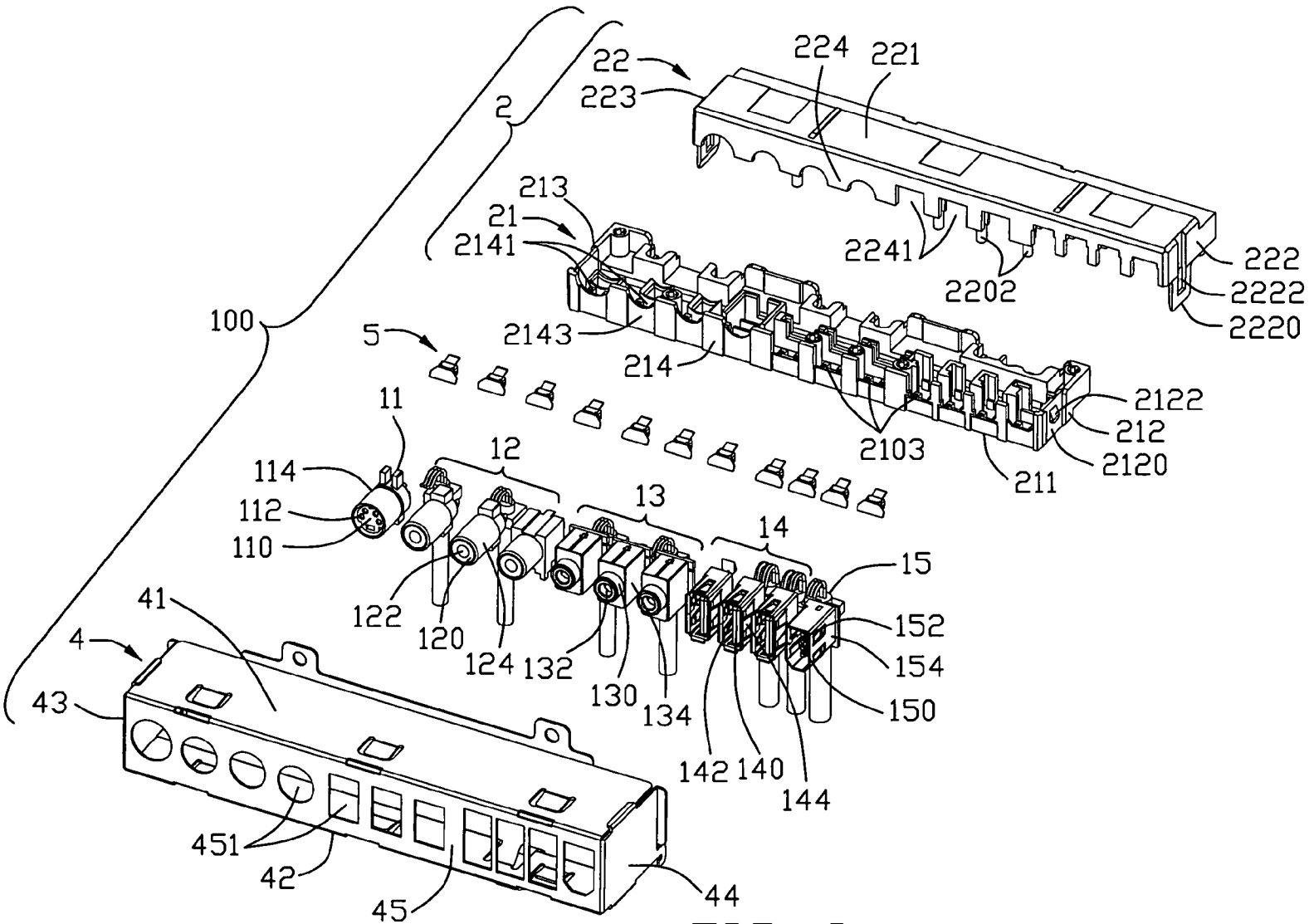
FIG. 3 is an exploded, perspective view of the electrical connector assembly.
Figure 4:
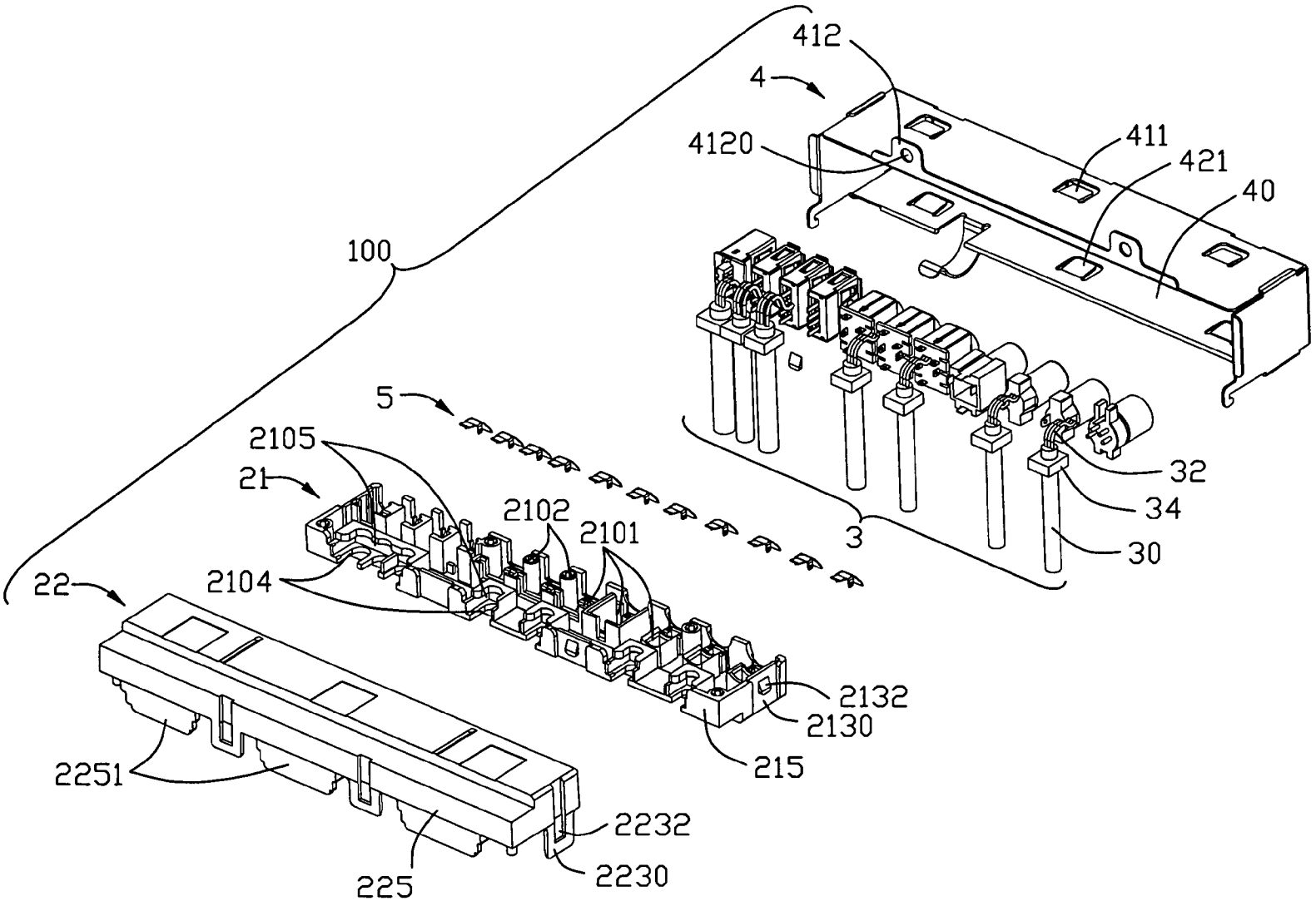
FIG. 4 is a view similar to FIG. 3, but viewed from another aspect.
Figure 5:
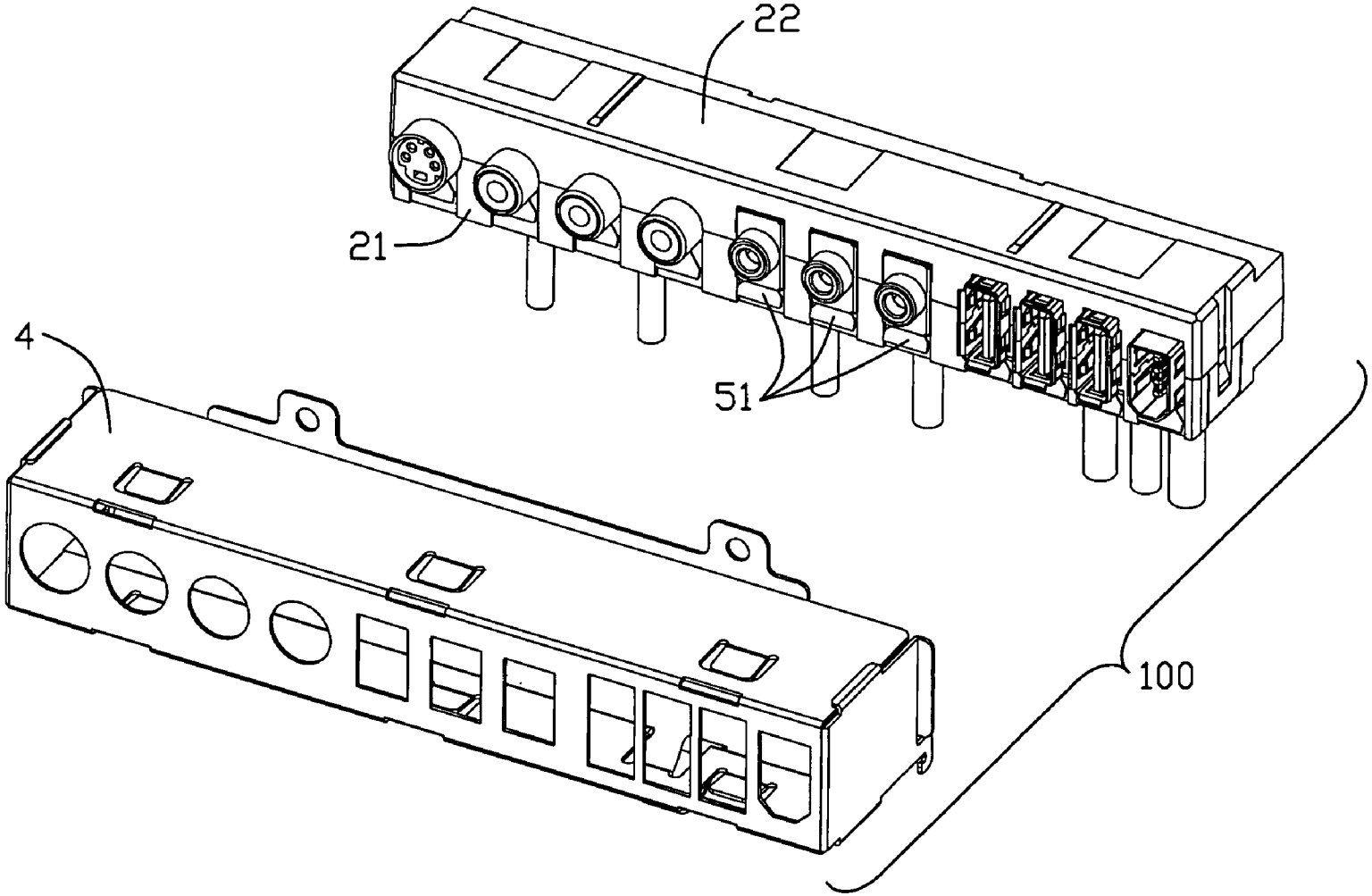
FIG. 5 is a partially assembled, perspective view of the electrical connector assembly.
Figure 6:
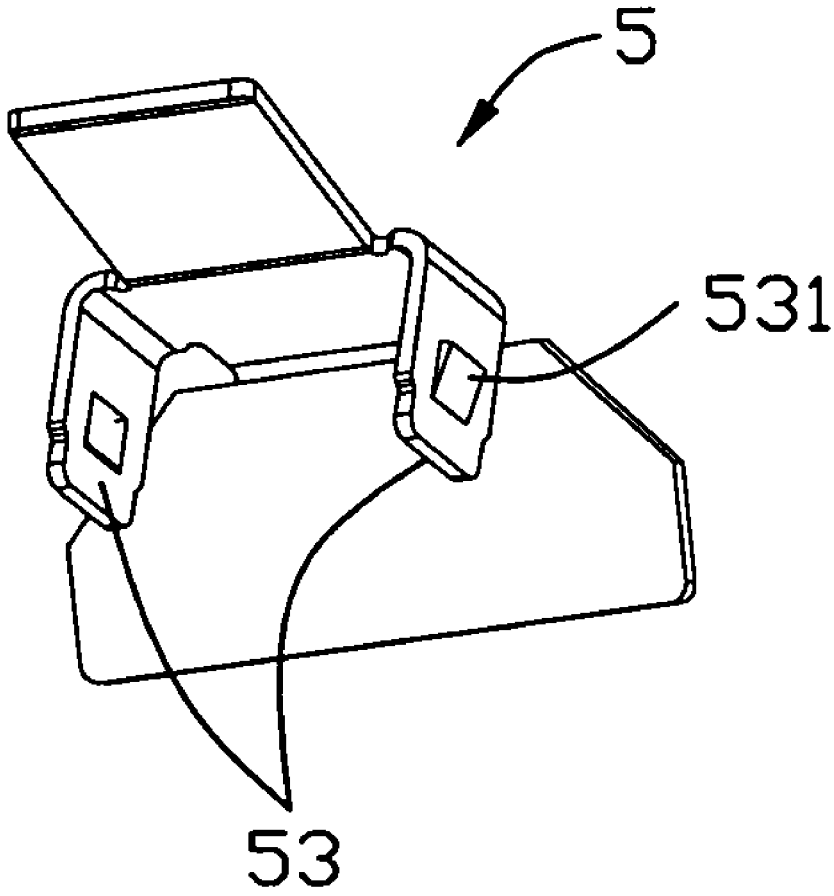
FIG. 6 is an enlarged view of a grounding member of the electrical connector assembly.
Figure 7:
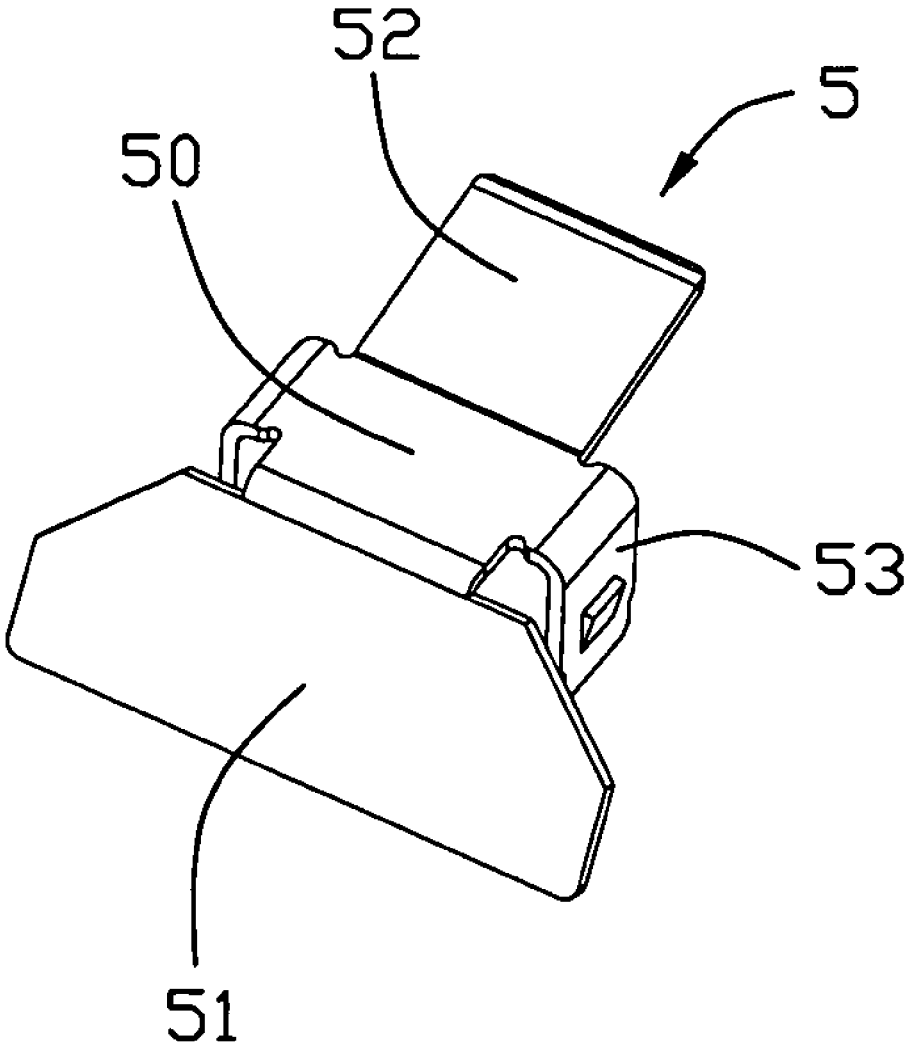
FIG. 7 is a view similar to FIG. 6, but viewed from another direction.
Figure 8:
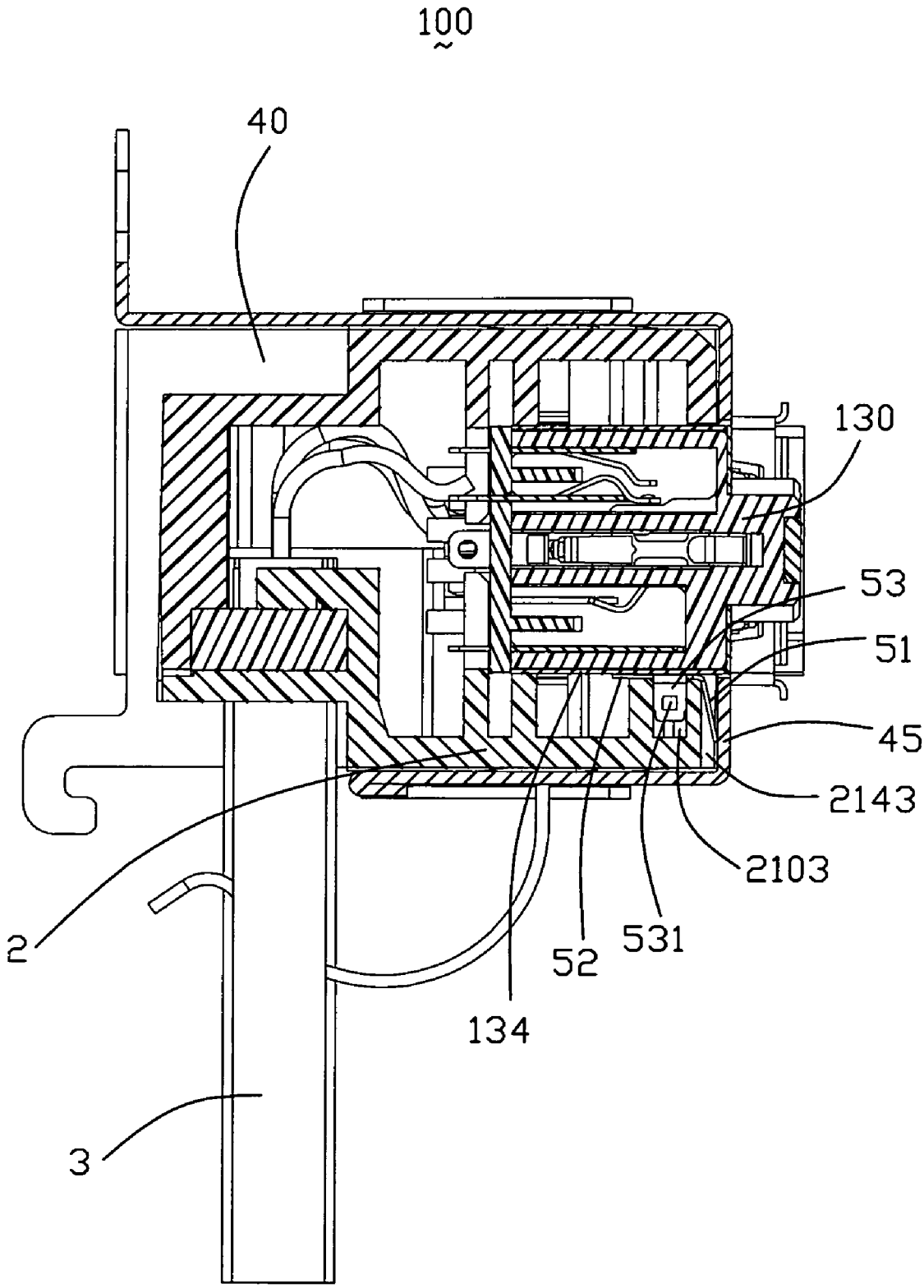
FIG. 8 is a cross-section view of FIG. 1 taken along line 8-8.

Referring to FIGS. 1-8, an electrical connector assembly 100 of a preferred embodiment in accordance with the present invention comprises a number of different connectors including a S-video connector 11, three RCA video connectors 12, three audio connectors 13, three USB connectors 14 and an IEEE 1394 connector 15, a connector holder 2, a plurality of cables 3 connected to the aforementioned connectors, a metallic cage 4 and a number of grounding members 5.

The S-video connector 11, three RCA video connector 12, the audio connectors 13, the USB connectors 14 and the IEEE 1394 connector 15 respectively include insulated housings 110, 120, 130, 140, 150, terminals 112, 122, 132, 142, 152 received in the corresponding insulated housings 110, 120, 130, 140 and 150, metallic shells 114, 124, 134, 144 and 154 enclosing the corresponding insulated housings 110, 120, 130, 140 and 150.

The connector holder 2 has a lower cover 21 and an upper cover 22.

The lower cover 21 includes a base portion 211, a pair of lateral walls 212, 213 respectively upright extending from lateral edges of the base portion 211, a front wall 214 and a back wall 215 extending upright from front and back edges of the base portion 211. A plurality of first positioning cavities 2101 are arranged in a row along a transversal direction and disposed in a front section of the base portion 211. Two slots 2103 are located in a front portion of each of the positioning cavities 2101. A plurality of first openings 2141 are defined in the front wall 214, located in front of and in communication with the first positioning cavities 2101. A number of engaging holes 2102 are spaced apart each other and formed on the base portion 211. Two depressions 2120, 2130 are respectively defined in the pair of lateral walls 212, 213, and two tabs 2122, 2132 are respectively formed in the two depressions 2120, 2130. A number of cable exiting outlets 2104 are defined in a back section of the base portion 211, and corresponding cable positioning cavities 2105 are disposed above the cable exiting outlets 2104.

The upper cover 22 includes a base portion 221, a pair of lateral walls 222, 223 respectively downwardly extending from lateral edges of the base portion 221, a front wall 224 and a back wall 225 extending downwardly from front and back edges of the base portion 221. A plurality of second positioning cavities corresponding with the first positioning cavities 2101 are disposed in a front section of the base portion 221. A plurality of second openings 2241 are defined in the front wall 224, located in front of and in communication with the second positioning cavities. A number of post 2202 are formed on the base portion 221 and aligned with the engaging holes 2102. A pair of clasp portions 2220, 2230 extend downwardly from bottom edges of the lateral walls 222, 223, with cavities 2222, 2232 defined therein respectively. A number of vertical boards 2251 extend downwardly from a bottom surface of the back wall 225.

The metallic cage 4 is stamped of a metallic sheet, including a top side 41, a bottom side 42, a front side 45 and a pair of transversal sides 43, 44 interconnected each other to form a receiving space 40. The front side 45 of the metallic cage 4 defines a number of through holes 451 for mating portions of the connectors passing through. A number of spring tabs 411, 421 are formed on the top side 41 and a bottom side 42 and further extend into the receiving space 40. A pair of mounting portions 412 are formed at rear edges of the top side 41, with a pair of holes 4120 defined therein.

Each of the grounding members 5 includes a body portion (mediating portion) 50, a first contacting portion 51 extending forwardly and downwardly from a front edge of the body portion 50, a second contacting portion 52 extending rearwardly and upwardly from a back edge of the body portion 50, and a pair of arms 53 extending downwardly from lateral edges of the body portion 50. Furthermore, each arm 53 has a barb/tiny tab 531 formed on outer surface thereof. However, the barb 531 may be formed on inner surface of the arm 53, or front/rear edge thereof in alternative embodiment.

Each of the cables 3 includes a number of wires 32, an insulated jacket 30 enclosing the wires 32 therein and an insulator 34 attached to a front portion of the insulated jacket 30.

When assemble, the wires 32 of the cables 3 are respectively soldered to the terminals 112, 122, 132, 142 and 152 of the aforementioned connectors 11, 12, 13, 14 and 15. The grounding members 5 are mounted to the first positioning cavities 2101 of the lower cover 21, with the two arm portions 53 of each grounding member 5 interferentially received in the slots 2103, the first contacting portion 51 disposed in front of a corresponding cavity 2143 defined in a lower section of a front side of the front wall 214, the second contacting portion 52 and the body portion 50 accommodated in the corresponding first cavity 2101. The connectors 11, 12, 13, 14 and 15 are mounted to the first cavities 2101, with the metallic shells 114, 124, 134, 144 and 154 thereof pressing onto the second contacting portions 52, the mating ports (front portions) of the connectors 11, 12, 13, 14, 15 extending beyond the front side of the front wall 214. The cables 3 extend outward the lower cover 21 via cable exiting outlets 2104 and the insulators 34 accommodated in the cable positioning cavities 2105. The upper cover 22 is assembled to the lower cover 21, with the posts 2202 inserted into the engaging holes 2102, the clasp portions 2220, 2230 sliding along the depressions 2120, 2130, and the tabs 2122, 2132 locked into cavities 2222, 2232 defined therein. The connector holder 2 is inserted into the receiving space 40, with the mating ports of the connectors 11, 12, 13, 14, 15 passing the through holes 451 of the front side 45 of the metallic cage 4, and the first contacting portions 51 of the grounding members 5 pressing onto the front side 45 of the metallic cage 4. The spring tabs 411, 421 of the metallic cage 4 locked into the corresponding cavities defined in a top side and bottom side of the upper cover 22 and the lower cover 21. Thus, the connector holder 2 and the metallic cage 4 are combined together. The first contacting portions 51 of the grounding members 5 are accommodated in the cavities 2143 of the lower cover 21 and resiliently press onto an inner surface of the front side 45 of the metallic cage 4, and the second contacting portions 52 resiliently press onto metallic shells 114, 124, 134, 144 and 154 of the connectors. Therefore, a grounding path is formed between the connectors and the metallic cage 4.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly, comprising:

a connector holder defining a plurality of positioning cavities therein, and at least a slot located in a front portion of each of the positioning cavities;

a plurality of grounding members respectively mounted to the positioning cavities, each of the grounding members having a body portion, a first contacting portion connected to a front edge of the body portion, a second contacting portion connected to a back edge of the body portion and at least an arm connected to a lateral edge of the body portion, said at least an arm received in the at least a slot, and the first contacting portion disposed out of the connector holder;

a plurality of connectors respectively mounted to the positioning cavities, each of the connectors having a metallic shell contacting the second contacting portion; and a metallic cage enclosing the connector holder and the connectors, with the first contacting portion contacting inner surface of the metallic cage.

2. The electrical connector assembly as claimed in claim 1, wherein the arm of the grounding member has a barb thereon.

3. The electrical connector assembly as claimed in claim 1, wherein the first contacting portion and the second contacting portion of the each grounding members resiliently press onto the metallic shell and the metallic cage.

4. The electrical connector assembly as claimed in claim 3, wherein the first contacting portion extends forwardly and downwardly from a front edge of the body portion, a second contacting portion extends rearwardly and upwardly from a back edge of the body portion.

5. The electrical connector assembly as claimed in claim 3, wherein the connector holder includes a lower cover and an upper cover combined together to enclose the connectors therein.

6. The electrical connector assembly as claimed in claim 1, wherein the upper cover has a pair of lateral walls, with a pair of clasp portions extending downwardly from bottom edges thereof, wherein the lower cover has a pair of lateral walls, with a pair of protrusion members formed thereon to latch with the clasp portions.

7. The electrical connector assembly as claimed in claim 6, wherein the pair of lateral walls define two depressions therein, with the protrusion members respectively located in middle area of the depressions, wherein the clasp portions are located in the depressions.

8. The electrical connector assembly as claimed in claim 1, further comprising a number of cables connected to the connectors.

9. The electrical connector assembly as claimed in claim 8, wherein a number of cables exiting outlets are defined in a back section of the connector holder, the cables extend outward through the cable exiting outlets and along a vertical direction.

10. The electrical connector assembly as claimed in claim 9, wherein a number of insulators are attached to the cables and accommodated in the connector holder.

11. An electrical connector assembly comprising:

an insulative holder defining a plurality of receiving cavities with respective first front openings communicating with an exterior;

a plurality of connectors disposed in the corresponding receiving cavities, respectively, each of said connectors being enclosed in the metallic shell;

a metallic cage enclosing said holder and defining a plurality of second front openings in alignment with the corresponding first front openings, respectively;

a plurality of conductive grounding elements each including a retention part retained in the corresponding receiving cavity, a first contact section engaged with the shell of the corresponding connector, and a second contact section engaged with the cage.

12. The electrical connector assembly as claimed in claim 11, wherein said second contact section engages an inner face of the cage.

13. The electrical connector assembly as claimed in claim 12, wherein said second contact section is located between the holder and the cage in a front-to-back direction.

14. The electrical connector assembly as claimed in claim 11, wherein each of said connectors defines a mating port extending forward through both the corresponding first front opening and second front opening beyond both the holder and the cage.

15. The electrical connector assembly as claimed in claim 11, wherein said retention part is received in a slot.

* * * * *